US005081973A

United States Patent [19]

Minamitani

[11] Patent Number: 5,081,973

[45] Date of Patent: Jan. 21, 1992

[54] IDLING SPEED CONTROL SYSTEM FOR ENGINE

[75] Inventor: Kunitomo Minamitani, Hiroshima, Japan

[73] Assignee: Mazda Motor Corporation, Hiroshima, Japan

[21] Appl. No.: 647,475

[22] Filed: Nov. 29, 1990

[30] Foreign Application Priority Data

Nov. 30, 1989 [JP] Japan ..... 1-312415

[51] Int. Cl.[5] ..... F02M 3/00

[52] U.S. Cl. ..... 123/339

[58] Field of Search ..... 123/339, 406, 417, 418, 123/426, 407; 417/34; 62/133

[56] References Cited

U.S. PATENT DOCUMENTS 4,966,112 10/1990 Shimomura ..... 123/339
4,976,238 12/1990 Toyoda ..... 123/339
4,976,589 12/1990 Ida ..... 417/34
5,002,026 3/1991 Ohkumo et al. ..... 123/339
5,010,863 4/1991 Ishida et al. ..... 123/339
5,012,779 5/1991 Fukui et al. ..... 123/339
5,018,362 5/1991 Nagase et al. ..... 123/339 X

FOREIGN PATENT DOCUMENTS 56-121843 9/1981 Japan ..... 123/339

*Primary Examiner*—Raymond A. Nelli
*Attorney, Agent, or Firm*—Sixbey, Friedman, Leedom & Ferguson

[57] ABSTRACT

An idling speed control system for an engine controls the amount of intake air during idling according to external load acting on the engine and feedback-controls the ignition timing by the use of a predetermined control variable so that the engine speed during idling converges on a target idling speed. The predetermined control variable is changed according to the amount of intake air charged to the engine.

8 Claims, 6 Drawing Sheets

| Ce \ Ne | 500 | 1000 | 1500 | ---- |
|---|---|---|---|---|
| 0.1 | 20 | 32 | 40 | ---- |
| 0.2 | 18 | 28 | 36 | ---- |
| 0.3 | 16 | 25 | 30 | ---- |
| 0.4 | 10 | 22 | 28 | --- |
| 0.5 | 6 | 20 | 26 | --- |
| ⋮ | ⋮ | ⋮ | ⋮ | --- |

| Ce | 0.1 | 0.2 | 0.3 | 0.4 | 0.5 | --- |
|---|---|---|---|---|---|---|
| thtreto | 25 | 21 | 15 | 13 | 11 | --- |

IDLING SPEED CONTROL SYSTEM FOR ENGINE

BACKGROUND OF THE INVENTION

1. Field of the Invention

This invention relates to an idling speed control system for stabilizing revolution of the engine during idling.

2. Description of the Prior Art

There has been known an idling speed control system in which the engine speed during idling is caused to converge on a target idling speed by feedback control of the ignition timing in which the ignition timing is controlled according to the difference between the actual engine speed during idling and the target idling speed, as disclosed for instance in Japanese Unexamined Patent Publication No. 56(1981)-121843.

A control variable for the feedback control of the ignition timing in order to cause the engine speed during idling to converge on the target idling speed such as a reference ignition timing, a range of control, a feedback control gain or the like has been determined so that it conforms to the state of the engine where the engine idles under no external load.

However, when the engine idles under external load such as an air conditioner, air is fed to the engine in a larger amount than when the engine idles under no load in order to keep the engine speed at a value equal to that when the engine idles under no load. When the amount of intake air increases, the burning rate increases, and accordingly, when the engine idles under no load, the engine output torque is maximized at an earlier ignition timing than when the engine idles under load as shown in FIG. 7. Further as can be seen from FIG. 7, the change in the engine output torque with change in the ignition timing is larger when the engine idles under load than when the engine idles under no load. Accordingly, when the feedback control of the ignition timing is effected during idling under load on the basis of the reference ignition timing for idling under no load, the engine output torque can be lowered since the reference ignition timing is too early to obtain the maximum engine output torque during idling under load. Further when the feedback control of the ignition timing is effected during idling under external load on the basis of the control gain for idling under no load, the engine output torque changes by a larger amount for a given change of the ignition timing than during idling under no load, whereby revolution of the engine cannot be stabilized.

SUMMARY OF THE INVENTION

In view of the foregoing observations and description, the primary object of the present invention is to provide an idling speed control system for an engine which can cause the engine speed during idling to smoothly converge on a predetermined idling engine speed irrespective of whether the engine idles under load or under no load.

In accordance with the present invention, there is provided an idling speed control system for an engine comprising an idle detecting means which detects that the engine idles, an ignition timing changing means which changes ignition timing of the engine, an intake air amount control means which controls the amount of intake air during idling according to external load acting on the engine, and a control means which feedback-controls the ignition timing changing means by the use of a predetermined control variable so that the engine speed during idling converges on a target idling speed, wherein the improvement comprises an intake air charging amount detecting means which detects the amount of intake air and a control variable changing means which changes said predetermined control amount of the control means according to the amount of intake air.

For example, the control means feedback-controls the ignition timing changing means using one or more of a basic ignition advance angle, an idle ignition retardation angle, a feedback control ignition advance angle, a feedback control range of the ignition timing, and the like as the control variable. Though the functions of these control variables will become apparent later, in accordance with the present invention, the basic ignition advance angle is generally reduced as the amount of intake air increases, the idle ignition retardation angle is reduced as the amount of intake air increases, the feedback control ignition advance angle is reduced as the amount of intake air increases, and the feedback control range of the ignition timing is narrowed as the amount of intake air increases.

When an external load such as an airconditioner begins to act on the engine and the amount of intake air is increased, the ignition timing at which the engine output torque is maximized is shifted toward the retardation side. By reducing the basic ignition advance angle when the external load begins to act on the engine, the ignition timing can be set at substantially optimal timing from beginning and the engine speed during idling can be controlled with a torque near a maximum value. Though the rate of change of the engine output torque with change of the ignition timing becomes larger when the engine begins to idle under external load, the overshoot of the engine output torque in response to adjustment of the ignition timing can be prevented by reducing the feedback control ignition advance angle (a feedback control gain), whereby the engine output torque can be quickly controlled to an optimal value. Accordingly, the engine speed during idling can be converged on a target speed with a high accuracy and the revolution of the engine during idling can be stabilized.

DESCRIPTION OF THE PREFERRED EMBODIMENT

Figure 1:
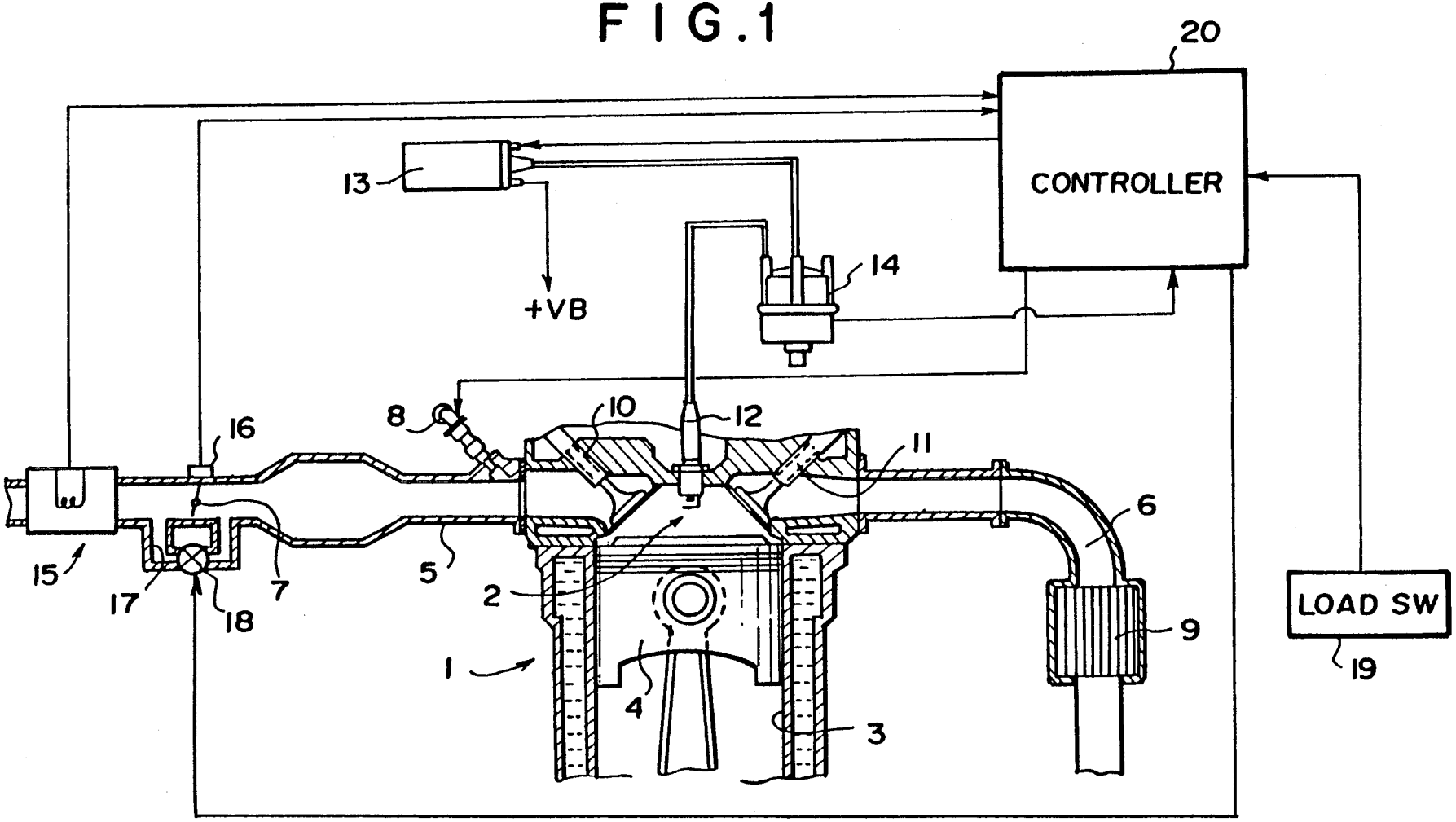
FIG. 1 is a schematic view showing an engine provided with an idling speed control system in accordance with an embodiment of the present invention.

In FIG. 1, an engine 1 has a combustion chamber 2 which is defined in a cylinder 3 by a piston 4 slidably received in the cylinder 3. An intake passage 5 communicates the combustion chamber 2 with the atmosphere and an exhaust passage 6 communicates the combustion chamber 2 with the atmosphere. A throttle valve 7 and a fuel injection valve 8 are provided in the intake passage 5, and a catalytic converter 9 is provided in the exhaust passage 6. The intake passage 5 is provided with a bypass passage 17 which bypasses the throttle valve 7, and a flow control valve 18 is provided in the bypass passage 17. Reference numerals 10, 11 and 12 respectively denote an intake valve, an exhaust valve and a spark plug. Reference numeral 13 denotes an ignition coil and a reference numeral 14 denotes a distributor. The crank angle or the engine speed is detected through the distributor 14.

Reference numerals 15 and 16 respectively denote a hot wire airflow meter and an idle switch. The idle switch 16 is turned on when the throttle valve 7 is full closed. The airflow meter 15 and the idle switch 16 are connected to a controller 20 which may comprise a CPU (central processing unit). The controller 20 controls the amount of fuel to be injected from the fuel injection valve 8 and controls the ignition timing. Further, a load switch 19 is connected to the controller 20 and outputs an ON signal when a load such as an airconditioner is operated. The controller 20 controls the flow control valve 18 in the bypass passage 17 so that the engine idles at a predetermined engine speed during idle. Accordingly, when the load is operated during idle, the controller 20 causes the flow control valve 18 to open wider so that air can be introduced into the combustion chamber 2 in an amount sufficient to maintain the predetermined engine speed during idle.

Figure 2A:
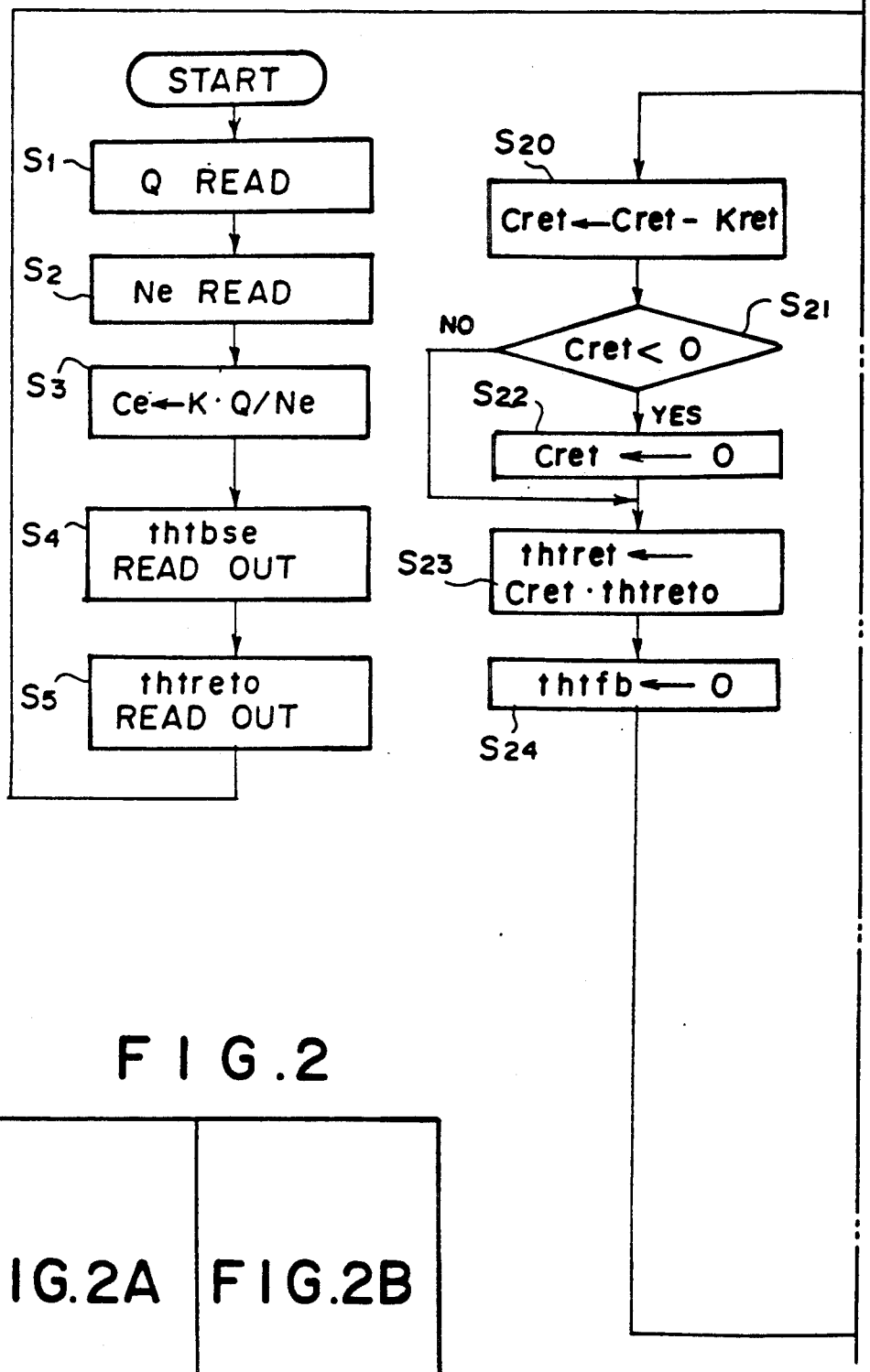
FIGS. 2A and 2B are flow charts for illustrating the operation of the controller.
Figure 2:
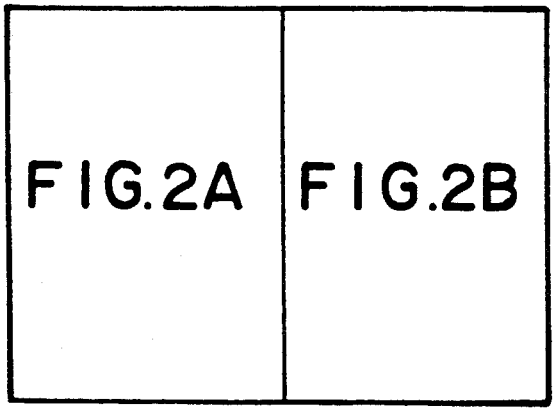
Figure 2B:
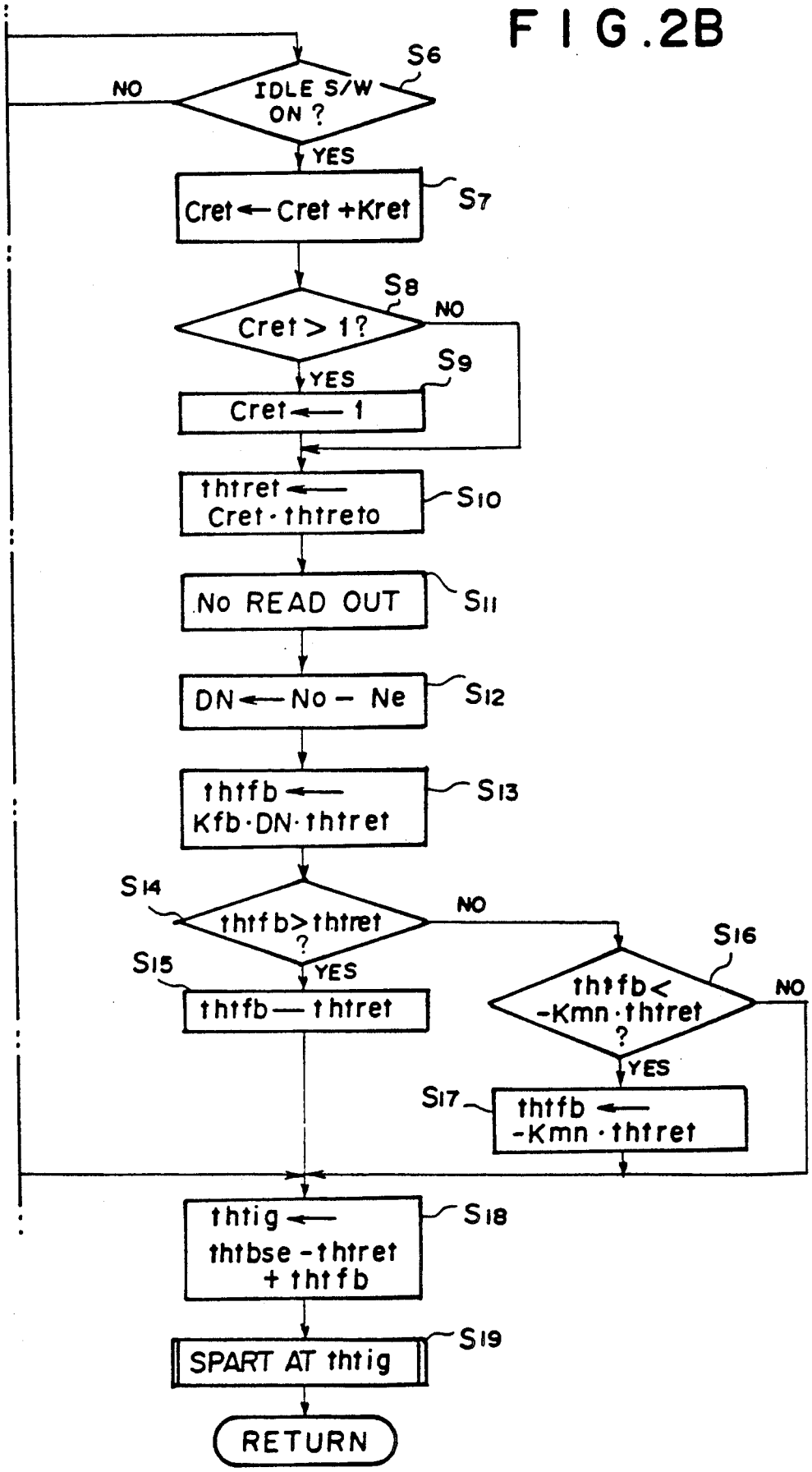

FIG. 2 shows a flow chart for illustrating the operation of the controller 20 to converge the engine speed during idling to a predetermined idling speed by feedback control of the ignition timing.

The controller 20 first reads the output signal Q of the airflow meter 15 and the output signal Ne of the engine speed sensor (the distributor 14). (steps S1 and S2) Then, in step S3, the controller 20 calculates the amount of air Ce which is charged to the engine 1 (will be referred to as "the intake air charging amount Ce", hereinbelow) according to formula $Ce = K \cdot Q/Ne$, K being a constant of proportionality.

Figures 3, 4, 5:
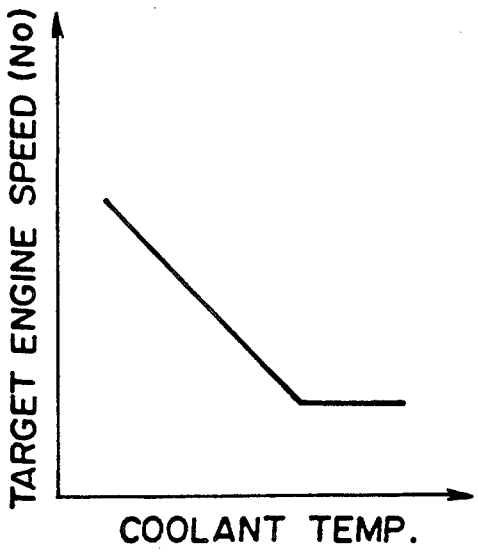
FIG. 3 is a view showing an example of a basic ignition advance angle map.
FIG. 4 is a view showing an example of an idle ignition retardation angle map.
FIG. 5 is a view showing the relation between the target engine speed and the temperature of the engine coolant.

In step S4, the controller 20 reads out, from the basic ignition advance angle map shown in FIG. 3, a basic ignition advance angle thtbse required to maximize the engine output torque at the engine speed Ne and the value of the intake air charging amount Ce calculated in step S3. In the map shown in FIG. 3, the basic ignition advance angle thtbase is set so that it decreases as the intake air charging amount Ce increases.

Then in step S5, the controller 20 reads out, from an idle ignition retardation angle map shown in FIG. 4, an idle ignition retardation angle thtreto for the value of the intake air charging amount Ce calculated in step S3. The idle ignition retardation angle thtreto is used for obtaining a reference value IgO shown in FIG. 6 on the basis of which feedback control of the ignition timing is to be effected. The reference value IgO is thus deviated from the ignition timing at which the engine output torque is maximized so that the engine output torque can be both increased and reduced. In the idle ignition retardation angle map shown in FIG. 4, the idle ignition retardation angle thtreto is set so that it increases as the intake air charging amount Ce decreases.

The controller 20 determines in step S6 whether the idle switch 16 is on, and when the idle switch 16 is on, the controller 20 proceeds to step S7 to perform feedback control of the ignition timing to converge the engine speed on a predetermined idling speed. In step S7, the controller 20 gradually increases an idle ignition retardation tailing coefficient Cret ($0 \leqq Cret \leqq 1$, initial value $= 0$) by adding thereto a constant Kret ($0 < Kret \leqq 1$) in order to gradually retard the ignition timing from the timing corresponding to the basic ignition advance angle thtbse to the timing retarded by the idle ignition retardation angle thtreto. When the idle ignition retardation tailing coefficient Cret becomes larger than 1, the controller 20 sets the value of the idle ignition retardation tailing coefficient Cret to 1 and calculates the value thret of the idle ignition retardation angle at this time according to following formula. (steps S8 to 10)

$$thret = Cret \cdot thtreto$$

Then in step S11, the controller 20 determines a target value No of the engine speed during idling according to the map shown in FIG. 5 in which the target value is increased as the engine coolant temperature is lowered. Further the controller 20 calculates, in step S12, the difference DN (No-Ne) between the target engine speed No and the actual idling speed Ne, and calculates, in step S13, a feedback control ignition advance angle thtfb (as a control gain) according to the following formula on the basis of the idle ignition retardation angle thtret at this time.

$$thtfb = Kfb \cdot DN \cdot thtret,$$

wherein Kfb being a constant. Since the idle ignition retardation angle thtret increases with decrease of the intake air charging amount Ce, the feedback control ignition advance angle thtfb increases with decrease of the intake air charging amount Ce.

Figure 6:
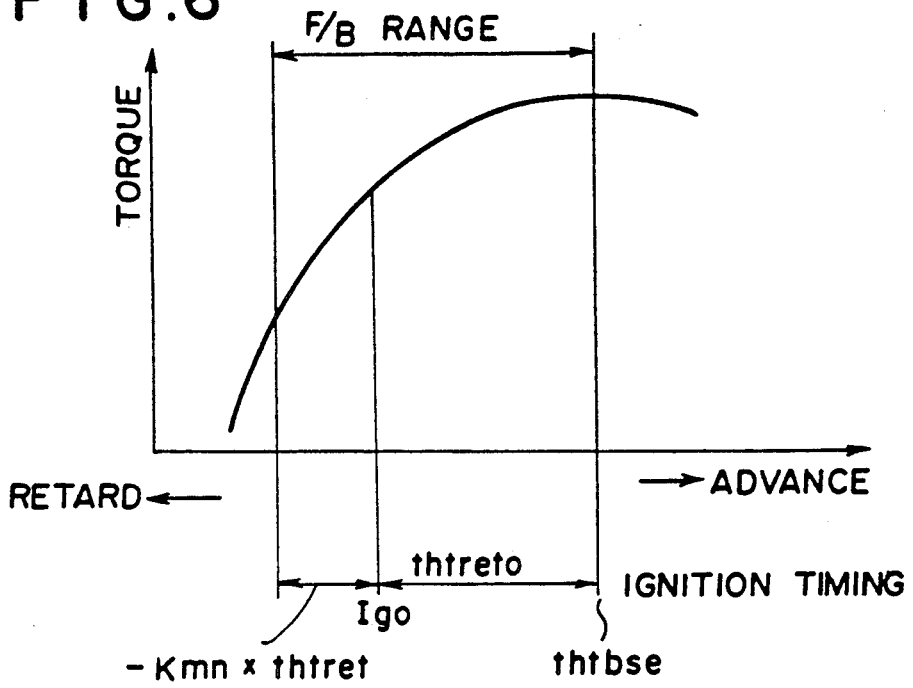
FIG. 6 is a view for illustrating the feedback control range of the ignition timing.

Thereafter, the controller 20 proceeds to step S14 and sets a feedback control range of the ignition timing, i.e., maximum and minimum values of the feedback control ignition advance angle thtfb, as shown in FIG. 6 on the basis of the idle ignition retardation angle thtret at this time. That is, the controller 20 compares, in step S14, the feedback control ignition advance angle thtfb with the idle ignition retardation angle thtret at this time, and when the former is larger than the latter, the controller 20 sets, in step S15, the value of the feedback control ignition advance angle thtfb to be equal to the idle ignition retardation angle thtret at this time. When the former is not larger than the latter, the controller 20 compares, in step S16, the feedback control ignition advance angle thtfb with the minimum value $-Kmn \cdot thtret$ (Kmn being a constant, e.g., 0.5), and when the former is smaller than the latter, the controller 20 sets, in step S17, the value of the feedback control ignition advance angle thtfb to be equal to the minimum value $-Kmn \cdot thtret$. Since the idle ignition retardation angle thtret is increased as the intake air charging amount Ce decreases as described above, the feedback control range of the ignition timing is enlarged as the intake air charging amount Ce decreases.

Then the controller 20 calculates a final ignition timing thtig according to the following formula on the basis of the basic ignition advance angle thtbse, the idle ignition retardation angle thtret at this time and the feedback control ignition advance angle thtfb.

$$thtig = thtbse - thtret + thtfb$$

And then the controller 20 outputs an ignition signal to the ignition coil 13 to cause the spark plug 12 to spark at the final ignition timing thtig. (steps S18 and 19)

When the idle switch 16 is turned off, the controller 20 proceeds to step S20 from step S6. In step S20, the controller 20 gradually decreases the idle ignition retardation tailing coefficient Cret by subtracting therefrom (which has been set at 1) the constant Kret in order to gradually return the ignition timing to the timing corresponding to the basic ignition advance angle thtbse. When the idle ignition retardation tailing coefficient Cret becomes smaller than 0, the controller 20 sets the value of the idle ignition retardation tailing coefficient Cret to 0 and calculates the idle ignition retardation angle thtret at this time according to following formula, thereby gradually decreasing the idle ignition retardation angle thtret.

$$thret = Cret \cdot thtreto$$

(steps S22 to 23) Thereafter, the controller 20 sets the feedback control ignition advance angle thtfb at 0 in step S24, and proceeds to steps S18 and S19.

Figure 7:
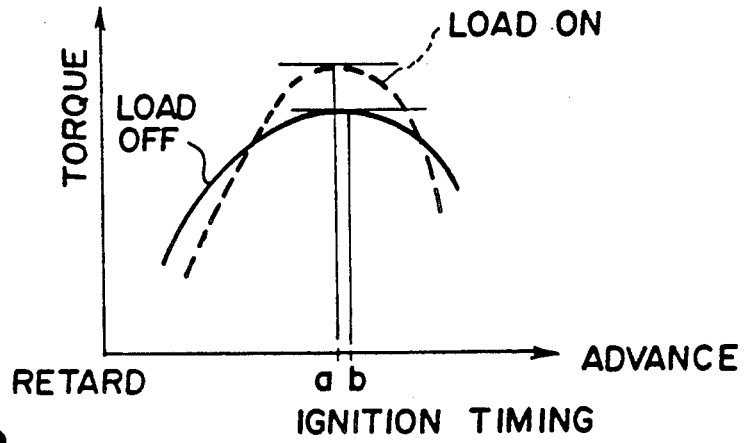
FIG. 7 is a view showing the relation between the ignition timing and the engine output torque when the engine operates under load and under no load.
Figure 9:
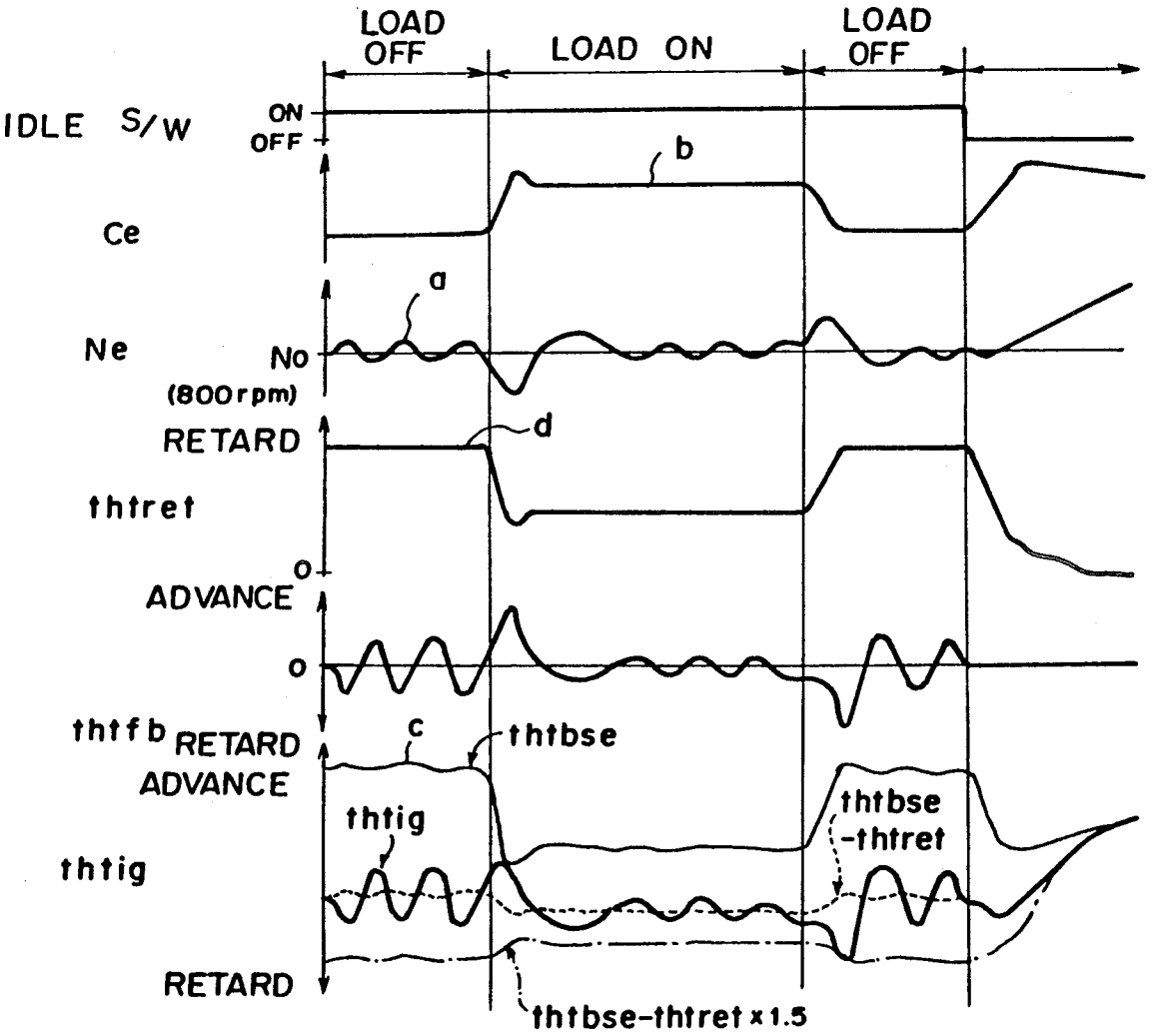
FIG. 9 is a view for illustrating the operation of the idling speed control system of the present invention.

When external load such as an airconditioner begins to act on the engine 1 while the engine 1 idles under no load and the engine speed is caused to converge on a target engine speed No, e.g., 800 rpm as shown by line a in FIG. 9, the controller 20 causes the flow control valve 18 in the bypass passage 17 so that air can be introduced into the combustion chamber 2 in an amount sufficient to maintain the target engine speed No as shown by line b in FIG. 9. As the intake air charging amount is thus increased, the engine output torque is maximized at a later ignition timing and the change in the engine output torque with change in the ignition timing becomes larger as described above in conjunction with FIG. 7.

In the idling speed control system in accordance with this embodiment, the basic ignition advance angle thtbase is set so that it decreases as the intake air charging amount Ce increases as shown by line c and the idle ignition retardation angle thtreto is set so that it decreases as the intake air charging amount Ce increases as shown by line d. Accordingly, the ignition timing can be controlled to the timing at which the engine output torque is maximized and the engine speed Ne during idle can be converged to the target engine speed No without lowering the engine output torque.

Figure 8:
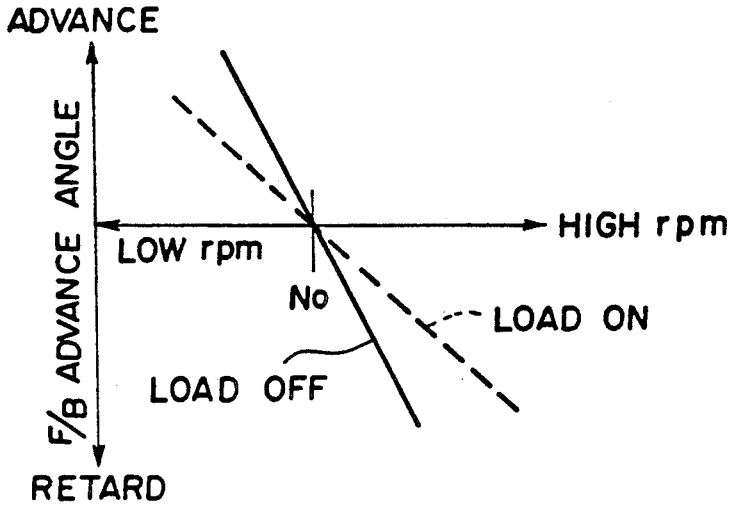
FIG. 8 is a view showing the relation between the intake air charging amount and the rate of change in the feedback control ignition advance angle with change in the difference between the target engine speed and the actual idling speed.

Further, in the idling speed control system in accordance with this embodiment, the feedback control ignition advance angle thtfb is set on the basis of the idle ignition retardation angle thtreto and accordingly, the rate of change of the feedback control ignition advance angle thtfb (control gain) with change in the difference between the target engine speed No and the actual idling speed Ne becomes smaller as the intake air charging amount increases (as the engine load becomes heavier) as shown in FIG. 8. Further, since the range of the value which the feedback control ignition advance angle thtfb can take is set on the basis of the idle ignition retardation angle thtreto and is narrower as the intake air charging amount is increased, the engine output torque can be finely controlled even if the rate of change in the engine output torque for a given change in the ignition timing is increased, whereby the idling engine speed Ne can be converged on the target engine speed No with high accuracy.

I claim:

1. An idling speed control system for an engine comprising an idle detecting means which detects that the engine idles, an ignition timing changing means which changes ignition timing of the engine, an intake air amount control means which controls the amount of intake air during idling according to external load acting on the engine, and a control means which feedback-controls the ignition timing changing means by the use of a predetermined control variable so that the engine speed during idling converges on a target idling speed, wherein the improvement comprises an intake air charging amount detecting means which detects the amount of intake air charged to the engine and a control variable changing means which changes said predetermined control variable of the control means according to the amount of intake air charged to the engine.

2. An idling speed control system as defined in claim 1 in which said predetermined control variable is a basic ignition advance angle for obtaining an ignition timing at which the output torque of the engine is expected to be maximized, and the basic ignition advance angle is reduced as the amount of intake air charged to the engine increases.

3. An idling speed control system as defined in claim 1 in which said predetermined control variable is an idle ignition retardation angle for deviating the ignition timing from that at which the engine output torque is expected to be maximized so that the engine output torque can be both increased and reduced, and the idle ignition retardation angle is reduced as the amount of intake air charged to the engine increases.

4. An idling speed control system as defined in claim 1 in which said predetermined control variable is a feedback gain which is determined according to the difference between the actual engine speed and the target idling speed, and the feedback gain for a given value of the difference is reduced as the amount of intake air charged to the engine increases.

5. An idling speed control system as defined in claim 4 in which said feedback gain is a function of the difference between the actual engine speed and the target idling speed and an idle ignition retardation angle for deviating the ignition timing from that at which the engine output torque is expected to be maximized so that the engine output torque can be both increased and reduced.

6. An idling speed control system as defined in claim 1 in which said predetermined control variable is a feedback control range of the ignition timing, and the feedback control range is narrowed as the amount of intake air charged to the engine increases.

7. An idling speed control system as defined in claim 1 in which said amount of intake air charged to the engine is represented by formula $K \cdot Q/Ne$ wherein Q represents an output of an airflow sensor, Ne represents an output of an engine speed sensor, and K represents a constant.

8. An idling speed control system as defined in claim 1 in which said control means feedback-controls the ignition timing changing means using, as control variables, a basic ignition advance angle for obtaining an ignition timing at which the output torque of the engine is expected to be maximized, an idle ignition retardation angle for deviating the ignition timing from that at which the engine output torque is expected to be maximized so that the engine output torque can be both increased and reduced, a feedback gain which is determined according to the difference between the actual engine speed and the target idling speed, and a feedback control range of the ignition timing, the basic ignition advance angle being reduced as the amount of intake air charged to the engine increases, the idle ignition retardation angle being reduced as the amount of intake air charged to the engine increases, the feedback gain for a given value of the difference being reduced as the amount of intake air charged to the engine increases, and the feedback control range being narrowed as the amount of intake air charged to the engine increases.

* * * * *